US005668442A

United States Patent [19]

Goebel et al.

[11] Patent Number: 5,668,442

[45] Date of Patent: Sep. 16, 1997

[54] PLASMA-ASSISTED TUBE WITH HELICAL SLOW-WAVE STRUCTURE

[75] Inventors: Dan M. Goebel, Tarzana; Jennifer M. Butler, Pacific Palisades; Robert L. Eisenhart, Woodland Hills, all of Calif.

[73] Assignee: Hughes Electronics, Los Angeles, Calif.

[21] Appl. No.: 242,570

[22] Filed: May 13, 1994

[51] Int. Cl.[6] ..... H01J 23/27; H01J 25/61

[52] U.S. Cl. ..... 315/39; 315/39.3; 313/35; 313/36

[58] Field of Search ..... 315/3.5, 3.6, 39.3, 315/39; 313/35, 36, 22; 333/162

[56] References Cited

U.S. PATENT DOCUMENTS

| | | | |
|---|---|---|---|
| 2,761,915 | 9/1956 | Pierce | 315/39.3 X |
| 3,171,053 | 2/1965 | Targ et al. | 331/82 X |
| 3,309,556 | 3/1967 | Lien | 333/162 X |
| 3,617,798 | 11/1971 | Marchese et al. | 315/3.5 |
| 3,663,858 | 5/1972 | Lisitano | 315/39 |
| 4,138,625 | 2/1979 | Koyama et al. | 315/3.5 |
| 4,585,973 | 4/1986 | Finch et al. | 315/3.5 |
| 4,912,367 | 3/1990 | Schumacher et al. | 315/3.5 |
| 4,916,361 | 4/1990 | Schumacher et al. | 315/111.21 |

OTHER PUBLICATIONS

Samuel Y. Liao, *Microwave Devices and Circuits*, Prentice Hall, Englewood Cliffs, 1990, pp. 382–398.

*Primary Examiner*—Benny T. Lee

*Attorney, Agent, or Firm*—Vijayalakshmi Duraiswamy; Wanda K. Denson-Low

[57] ABSTRACT

Microwave amplifiers are disclosed having a hollow helix slow-wave structure coupled directly to input and output waveguides. This helix-waveguide coupling structure couples the TEM mode of the helix to the TE10 mode of the rectangular waveguides and also defines ports communicating with the helix interior. Heating of the helix during high-power operation can be removed by cooling liquid pumped through the helix via these ports. The helix is surrounded by a cylindrical housing containing a low-pressure ionizable gas which forms a plasma channel that focuses the electron beam without the need for surrounding magnetic structures. A plasma cathode electron gun is arranged to inject an electron beam through the helix. Backflowing ions from the housing are harmlessly absorbed into the face of the plasma cathode. The microwave amplifier is converted to a backward wave oscillator by coupling a load to one of the waveguides.

8 Claims, 3 Drawing Sheets

PLASMA-ASSISTED TUBE WITH HELICAL SLOW-WAVE STRUCTURE

BACKGROUND OF THE INVENTION

1. Field of the Invention

The present invention relates generally to high-power microwave amplifiers and oscillators.

2. Description of the Related Art

A plasma-assisted high-power microwave generator was disclosed in U.S. Pat. No. 4,912,367 issued Mar. 27, 1990 in the name of Robert W. Schumacher et al. and assigned to Hughes Aircraft Company, the assignee of the present invention. A preferred embodiment in accordance with that patent included a plasma-cathode electron gun coupled to a gas-filled, slow-wave structure (SWS) in the form of a rippled-wall waveguide.

In particular, the electron gun incorporated a plasma cathode in the form of a hollow enclosure filled with a low pressure ionizable gas, e.g., helium or hydrogen. A keep-alive anode was extended into the enclosure and biased to maintain a low current discharge through the gas. Negative pulses applied across the gas then produced a pulsed plasma of electrons and positive ions. A grid and an anode spaced therefrom were positioned adjacent an enclosure outlet. Beam voltage impressed across the anode and grid extracted an electron beam from the plasma and injected it into the tippled-wall waveguide.

Passage of the electron beam through the ionizable waveguide gas produced ions that neutralized the beam and prevented space charge blowup, i.e., a magnetic confining force was produced by the axial beam current which produced an azimuthal magnetic field. This field acted back upon the electron beam to generate a radially inward-directed force thereupon.

The rippled-wall waveguide acted as a slow wave structure to reduce the phase velocity of the electromagnetic waveguide mode so as to match the speed of the electron beam which drifted at less than the speed of light. Space-charge waves on the beam were then resonantly coupled to waveguide modes to transfer energy from the electron beam to a microwave signal which could be coupled to space through an output horn antenna.

Microwave generators in accordance with this structure are capable of high-power, long-pulse radiation, e.g., approximately 1 MW and 100 microseconds, and this is accomplished with a system that neutralizes electron beam space-charge blowup without the use of externally generated magnetic fields. Although some conventional microwave sources, e.g., state-of-the-art klystrons, can achieve these peak power levels and pulse widths, they typically do so with the aid of beam controlling external magnetic fields. These fields are established with surrounding magnetic structures and attendant power supplies that increase the generator size and weight.

However, the resultant microwave signal in the rippled-wall waveguide propagates with the cylindrically symmetric TM01 electromagnetic mode and the waveguide operates near the cutoff frequency of this mode. Because cutoff frequency is inversely proportional to the SWS radius, this property of the rippled-wall waveguide causes the structure to become undesirably large as the operating frequency is reduced to the lower microwave frequencies, e.g., approximately 25 centimeters in diameter and several meters long at 1 GHz.

In addition, the rippled-wall waveguide generator performance is characterized by a small bandwidth and a frequency that varies with beam voltage only in discrete steps with reduced power output between these steps. Finally, the TM01 propagation mode provides a microwave output having an axial null which is difficult to couple to conventional circular or rectangular waveguides. This tippled-wall waveguide feature has typically dictated the use of large, complicated mode converters.

The rippled-wall waveguide is but one example of a slow-wave structure that reduces the electromagnetic wave velocity so that it can interact with an electron beam. Other examples include helixes and coupled cavities. When a helix is used as the slow-wave structure in a microwave tube (commonly called a helix traveling-wave tube), the electron beam is typically controlled to flow through the helix by magnetic focusing structures that envelope the tube. The electron beam is usually formed by a heated cathode which shares the tube interior with the helix and the tube interior is maintained at a high vacuum.

The use of helix slow-wave structures is typically limited to applications where the average power is below 10 kW because of temperature buildup in the helix. In addition, terminations at each end of the helix are generally supported by electrical dielectric structures which are susceptible to arcing when the peak-power exceeds 100 kW. A variety of references describe helix traveling-wave tubes in detail, e.g., Samuel Y. Liao, *Microwave Devices and Circuits*, Prentice Hall, Englewood Cliffs, 1990, pp. 382–398.

In contrast with the structures described above, some plasma-assisted microwave generators operate by directing two counter-propagating electron beams into a plasma filled waveguide structure. Such structures inherently become more complex and voluminous since two separate electron beam gun structures and attendant coupling with the plasma filled waveguide are typically required. An exemplary generator of this type is described in U.S. Pat. No. 4,916,361 which issued Apr. 10, 1990 in the name of Robert W. Schumacher et al. and was assigned to Hughes Aircraft Company, the assignee of the present invention.

SUMMARY OF THE INVENTION

The present invention is directed to microwave amplifiers and oscillators capable of operation in the lower microwave region without an attendant increase in tube diameter. Microwave tubes in accordance with the invention are capable of high-power long-pulse operation without requiring magnetic beam focusing structures.

These goals are realized with a hollow helix slow-wave structure having a zero cut-off frequency and/a helix-waveguide coupling structure that facilitates a flow of cooling liquid through the helix to remove heat generated during high-power operation. The zero cut-off frequency of the helix facilitates a reduction of tube diameter which not only reduces size and weight, but enables tighter coupling with the tube's electron beam. The helix and its surrounding housing operates in the TEM mode, which is efficiently converted to the TE10 mode in input and output waveguides by the helix-waveguide coupling structure. Coupling of the helix ends through the housing sidewall prevents interference with the end of the housing, which can then be configured with a high-power, water-cooled beam collector and energy recovery devices. Because the helix is inherently a broadband device, tube tunability and agility are enhanced.

Microwave tubes in accordance with the invention are characterized by first and second waveguides arranged to communicate with a housing filled with low-pressure ionizable gas; a hollow helix positioned in the housing and having first and second ends each coupled electromagnetically with a respective one of the waveguides; and an electron gun arranged to inject an electron beam through the helix. The electron gun preferably has a plasma cathode to resist backstreaming ion bombardment from the gas surrounding the helix.

In accordance with a feature of the invention, each helix end is joined with a wall of its respective waveguide to define therewith a port communicating with the helix interior. The ports facilitate pumping of cooling liquid through the hollow helix for heat removal therefrom.

In a preferred embodiment each of the helix ends terminates electromagnetically at its respective waveguide wall in a substantially orthogonal relationship therewith. The housing is a cylindrical waveguide arranged coaxially with the helix to enhance coupling between the electron beam and the helix. The first and second waveguides respectively receive an input rf energy and couple an amplified rf energy from the tube. In another preferred embodiment the second waveguide terminates in a matched load and the first waveguide couples oscillator power from the tube.

The novel features of the invention are set forth with particularity in the appended claims. The invention will be best understood from the following description when read in conjunction with the accompanying drawings.

DESCRIPTION OF THE PREFERRED EMBODIMENTS

Figure 1A:
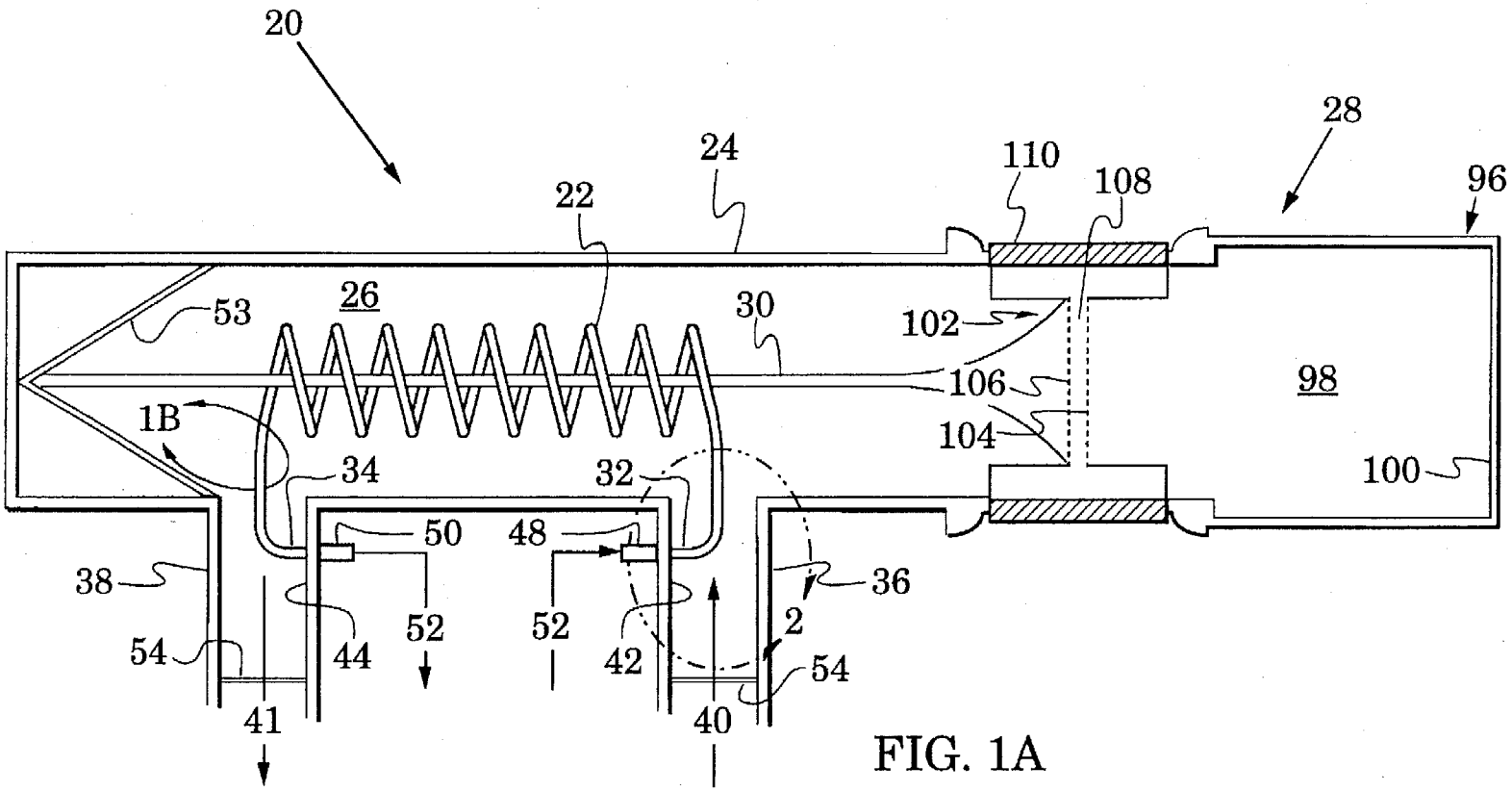
FIG. 1A is a sectional diagram of a preferred microwave source embodiment in accordance with the present invention.

FIG. 1A is a sectional diagram of a preferred microwave amplifier embodiment 20 in accordance with the present invention. The amplifier 20 includes a liquid-cooled hollow helix 22 carried within a housing in the form of a cylindrical waveguide 24. The waveguide 24 is filled with a low pressure ionizable gas 26. Coupled to the waveguide 24 is an electron gun 28 which is arranged to inject an electron beam 30 into the helix 22.

Figure 1B:
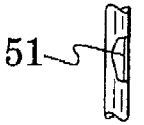
FIG. 1B is an enlarged view of the structure within the curved line 1B of FIG. 1A.

Opposing ends 32, 34 of the helix 22 are coupled respectively with input and output rectangular waveguides 36, 38 that communicate with the waveguide 24. Thus, rf input power 40 can flow from the waveguide 36 to the helix 22 and rf output power 41 can flow from the helix 22 to the waveguide 38, i.e., the amplifier 20 is configured as a forward-wave amplifier. The opposing helix ends 32, 34 are electrically terminated respectively at waveguide walls 42, 44. This helix-waveguide coupling structure facilitates installation of liquid flow ports 48, 50 that communicate with the helix interior via the helix ends 32, 34. For clarity of illustration, the helix interior 51 is shown in FIG. 1B which is an enlarged view of the structure within the curved line 1B of FIG. 1A.

In operation, an electromagnetic input wave 40 is transmitted along the helix 22 at the speed of light. However, the net axial velocity of the wave is less than the speed of light by a factor determined by the pitch of the helix 22, i.e., the helix operates essentially as a coiled coaxial line. The electron beam 30 can thereby have a phase velocity similar to the electromagnetic wave's axial phase velocity, causing a continual interaction that transfers energy therebetween. The microwave energy grows along the helix 22 and is coupled out into the waveguide 38. In this process, energy is also lost in the helix 22 structure with resultant heating thereof. However, the helix-waveguide coupling structure allows this heat to be conducted away by a cooling liquid 52, e.g., water, glycol, oil, pumped through the helix 22 via the ports 48, 50.

Unlike conventional high-power amplifiers, e.g., helix traveling-wave tubes, externally applied magnetic fields are not required in the amplifier 20 to confine and transport the electron beam 30 through the helix 22 because the negative space charge of the beam electrons is neutralized by a plasma channel created by ionization of the background gas 26.

The helix 22 and the helix-waveguide coupling structure illustrated in FIG. 1A introduce several favorable features into a plasma-assisted microwave source. These include the formation, via the helix 22 and cylindrical waveguide 24, of a coaxial TEM mode electromagnetic signal which has a zero cutoff frequency. Thus, the helix diameter does not have to expand as the amplifier 20 is configured for operation at lower microwave frequencies, e.g., L band.

Operating parameters that enter into the design of the helix structure include frequency, beam voltage, acceleration voltage, output power and helix pitch and diameter. The helix diameter can be selected to lower source size and weight and the other parameters designed accordingly. Tightly coupling the gas containing housing 24 to the helix 22 also facilitates a reduction of the helix diameter. Accordingly, the housing is preferably designed to be a cylindrical waveguide with a diameter that is between 1.5 and 3 times the helix diameter.

In addition, the helix-waveguide coupling structure facilitates a compact and direct connection to the input and output waveguides 36, 38, which reduces coupling losses. Because the helix permits a reduced structure diameter, a tighter coupling is possible between it and the electron beam with a consequent reduction in the rf turn-on time and an increase in output power.

The helix 22 sidewall coupling through the waveguide 24 avoids interference with a collector 53 positioned at the end of the waveguide 24. This facilitates the use of high-power water-cooled collectors and energy recovery systems which increase the average-power capability of the amplifier 20. Also, because the helix 22 is inherently a broadband device, amplifier frequency tunability and agility are enhanced.

Despite these inherent structural advantages, the use of helix slow-wave structures has typically been restricted to lower average-power applications, e.g., below 10 kW, because of excessive temperature buildup in the helix. In addition, various components have generally been disposed to connect the helix ends with the surrounding housing surfaces. These components include dielectric members for physical support of the helix and vacuum windows for maintenance of a high tube vacuum. Such connecting components provide materials and structural configurations, e.g., sharp edges, that increase susceptibility to arcing from the helix ends at high peak power, e.g., >100 kW.

In contrast, the helix-waveguide coupling embodiment illustrated in FIG. 1A electromagnetically and mechanically couples the helix ends 32, 34 to the waveguide walls 42, 44. This arrangement enables higher average-power operation because access is gained, via the waveguide walls, for coolant flow through the helix interior 51. The mechanical coupling to the waveguide wall provides the required support for the helix 22. A vacuum window 54 is formed of a suitable material, e.g., pyrex, and positioned across each waveguide 36, 38 to maintain the desired pressure of the gas 26. However, the windows 54 are spaced away from the helix ends 32, 34 to reduce the arcing potential. Thus, materials and structures are removed from or spaced away from the helix ends 32, 34 to facilitate higher peak-power operation.

Figure 2:
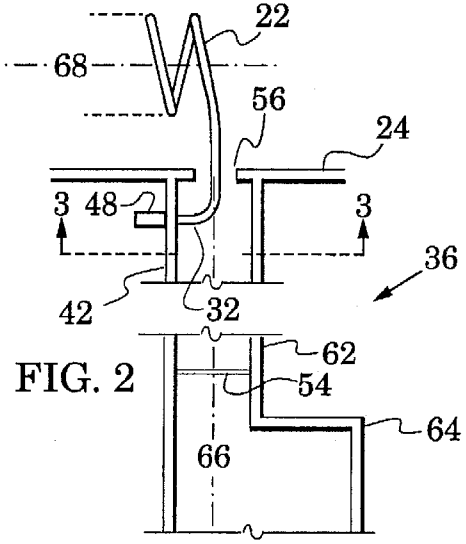
FIG. 2 is a view of the helix-waveguide coupling structure within the curved line 2 of FIG. 1A.
Figure 3:
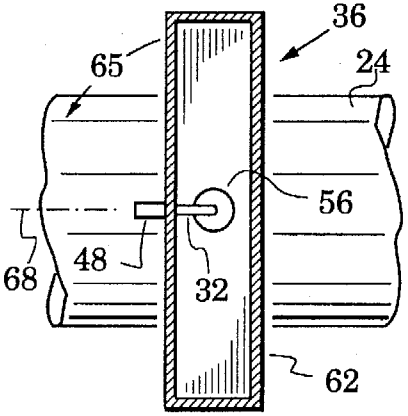
FIG. 3 is a view along the plane 3—3 of FIG. 2.

Directing attention now to a more detailed description, FIG. 2 is a view of the structure within the curved line 2 of FIG. 1A and FIG. 3 is a view along the plane 3—3 of FIG. 2. In accordance with a feature of the invention, the helix end 32 is passed through an aperture 56 in the wall of the waveguide 24 and electrically terminated in an orthogonal relationship with the waveguide wall 42 (see FIG. 2) where it is electrically terminated, e.g., brazed to the wall. The same structure is repeated at the helix end 34.

The helix ends 32, 34, joined to the center of their respective waveguide broad walls, thus function as waveguide antennas to convert energy between the TEM mode associated with the helix and the TE10 mode of the input and output waveguides 36, 38. As shown in FIGS. 2 and 3, the end 32 of the hollow helix 22 is mechanically led through the side wall 42 and terminated outside the waveguide 36 in a liquid coupling port 48 which communicates with the helix interior (51 in FIG. 1B). The helix-waveguide coupling structure of FIGS. 2, 3 is repeated at the output waveguide (38 in FIG. 1A), allowing an appropriate cooling system to be operatively connected to the ports 48, 50. The liquid flows through the helix 22 and removes heat generated therein during high-power amplifier operation.

The impedances of the waveguides 36, 38 are preferably matched to that of the circular waveguide 24 in a manner well known in the art, e.g., by stepping from a reduced-height, low-impedance waveguide segment 62 to a standard-height, high-impedance waveguide segment 64 as shown in FIG. 2 (a sectional view of the waveguide segment 62 is seen in FIG. The vacuum window 54 may be carried by the reduced-height segment 62. As indicated by the arrow 65 in FIG. 3, the waveguide 36 may be arranged in other angular relationships about its longitudinal axis 66 (see FIG. 2) to facilitate specific amplifier installations.

Figure 4:
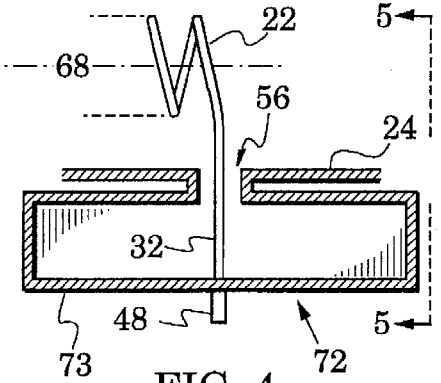
FIG. 4 is another preferred helix-waveguide coupling embodiment for use in the source of FIG. 1A.

In the coupling embodiment of FIGS. 2, 3, the longitudinal axis 66 (see FIG. 2) of the rectangular waveguide 36 is oriented orthogonal to the longitudinal axis 68 of the helix 22. Another preferred helix-waveguide coupling structure embodiment is shown in FIG. 4, which is a view similar to FIG. 2, and in FIG. 5 which is a view along the plane 5—5 of FIG. 4. As in the embodiment of FIGS. 2 and 3, the helix 22 is coaxially arranged within the cylindrical waveguide 24. In this embodiment, the axis 70 (see FIG. 5) of a rectangular waveguide 72 is oriented so that it and the longitudinal axis 68 (see FIG. 4) of the helix 22 lie in parallel planes. The end 32 of the helix 22 is passed through the aperture 56 in the wall of the waveguide 24. The helix end 32 is electrically terminated in the waveguide's broad wall 73 (see FIG. 4) and is mechanically led through the wall 73 and mechanically terminated outside the waveguide 72 in the liquid coupling port 48.

Figure 5:
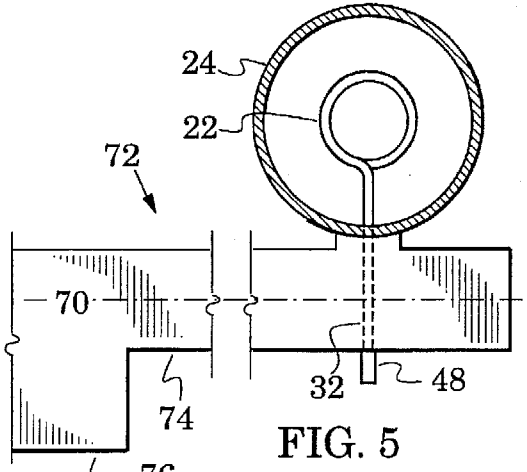
FIG. 5 is a view along the plane 5—5 of FIG. 4.

As in the coupling embodiment of FIGS. 2, 3, the waveguide 72 can be rotated about the helix end 32 as required for a particular system arrangement, e.g., the waveguide 72 can be rotated to place its longitudinal axis 70 parallel with the helix axis 68. As also described above, the waveguide 72 can be stepped between a high-impedance segment 76 and a low-impedance segment 74 as required to best match the waveguide 24 impedance as seen in FIG. 5.

Figure 6:
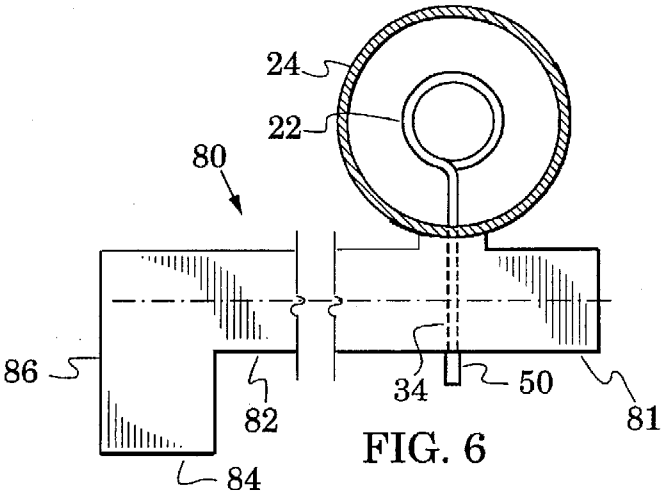
FIG. 6 is a preferred helix-waveguide matched load embodiment for use in microwave oscillators in accordance with the present invention.

The teachings of the present invention can be extended to microwave oscillators. For example, the amplifier 20 can be converted into a backward wave oscillator (BWO) by presenting a matched load to the helix end 34 as shown in the exemplary structure of FIG. 6. This figure is similar to FIG. 5 and shows a waveguide 80 coupled to the circular waveguide 24. As in the embodiment of FIGS. 4 and 5, the helix 22 is coaxially arranged within the cylindrical waveguide 24. The end 34 of the helix 22 is electrically terminated in the waveguide's broad wall 81 and is mechanically led through the wall 81 and mechanically terminated outside the waveguide 80 in the liquid coupling port 50.

The waveguide 80 is stepped from a reduced-height segment 82 to a standard-height segment 84 which is terminated in a short in the form of a transverse wall 86. The dimensions of this structure can be arranged in ways well known in the art to present a range of selected electromagnetic loads to the helix end 34. Other waveguide arrangements and terminations can also be arranged to present any of various electromagnetic loads to the helix end 34. The remaining helix structure is the same as shown in FIG. 1A, i.e., the helix end 32 is coupled to an output waveguide 36.

When the helix 22 is configured in this way and the electromagnetic load at the helix end 34 selected in accordance with ways well known in the art, the microwave energy flows in the opposite direction of the electron beam 30. The amplitude grows uniformly along the helix and the microwave energy is coupled out at the waveguide port 36 adjacent the electron gun 28.

As shown in FIG. 1A, the electron gun 28 is carried by the waveguide 24 and arranged to inject the electron beam 30 through the helix 22. The negative space charge of the beam 30 is neutralized by a plasma channel created by ionization of the background gas 26, and this channel serves to confine and transport the beam 30 without the aid of externally applied magnetic fields. This type of beam transport is typically called ion-focused regime (IFR) and, combined with the beam'sown self-magnetic field forces, pinches the beam 30 to high current densities, e.g., in excess of 200 $A/cm^2$.

The electron gun 28 of FIG. 1A preferably includes a plasma cathode 96. The plasma cathode is essentially a volume of ionizable gas 98 contained in a hollow cathode enclosure 100. Positioned across an enclosure outlet 102 is a discharge grid 104. A perforated anode 106 is spaced from the grid 104 to define an acceleration region 108 between them. The grid 104 and beam anode 106 are held in an insulating sleeve 110.

In operation, voltage pulses across the gas 98, e.g., applied between the enclosure 100 and the grid 104, produce a plasma source of electrons from which the electron beam 30 is extracted across the acceleration region 108 by a beam voltage impressed across the anode 106 and grid 104. Backstreaming positive ions from the gas 26 (surrounding the helix 22) are accelerated in the opposite direction across the acceleration region 108 and are harmlessly received by the gas 98.

An important feature of plasma-cathode electron guns is their ability to receive backstreaming ions without damage. Plasma-cathode electron guns similar to the gun 28 are well known in the microwave generator art, e.g., as taught in U.S. Pat. No. 4,912,367 which was referred to above in the related art section. Although plasma-cathode electron guns are particularly suited for use in the present invention, the teachings of the invention may, in general, be practiced with any electron gun that can accept backstreaming ion bombardment without damage.

Figure 7:
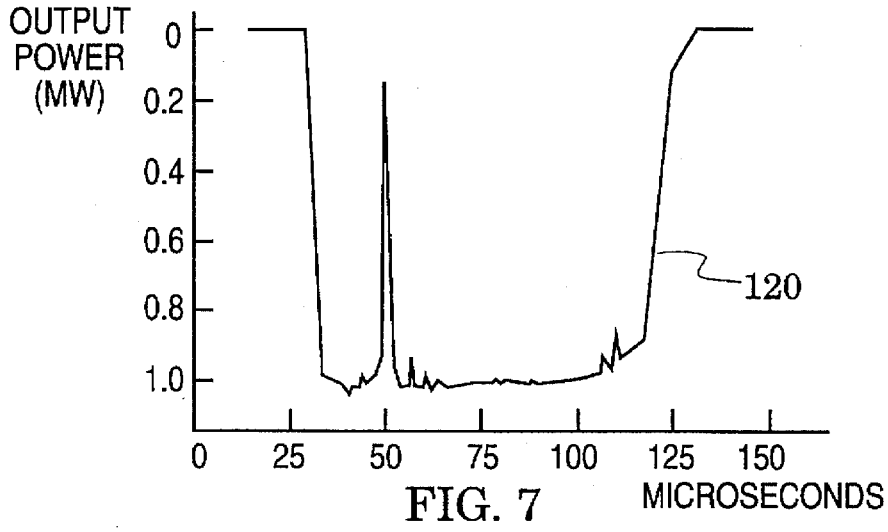
FIG. 7 is a graph of output power obtained in an exemplary microwave source fabricated in accordance with the present invention.
Figure 8:
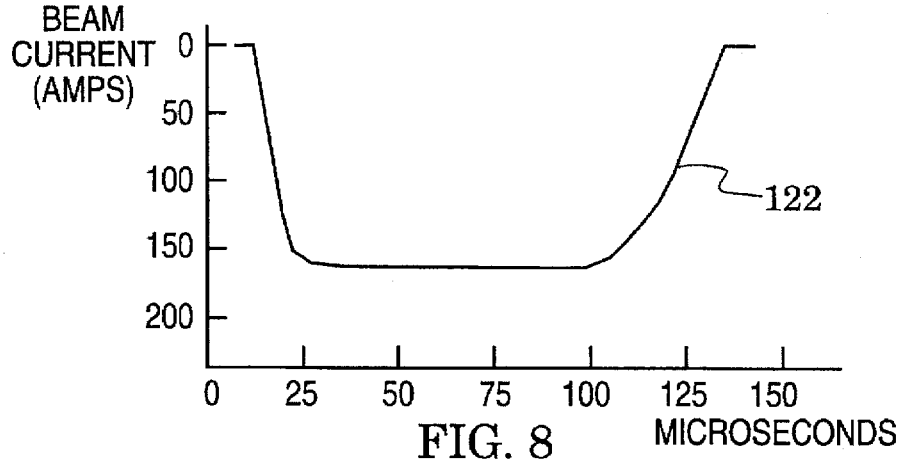
FIG. 8 is a graph of beam current corresponding to the output power of FIG. 7.
Figure 9:
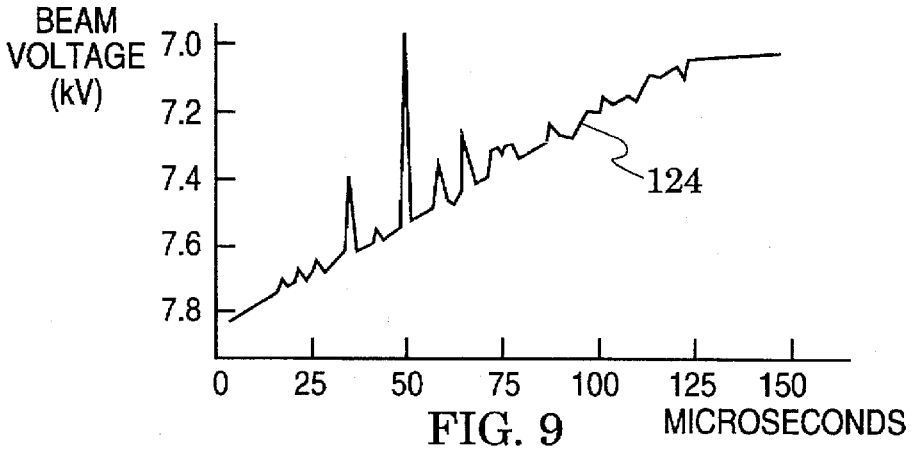
FIG. 9 is a graph of beam voltage corresponding to the output power of FIG. 7.

An exemplary BWO was constructed in accordance with the teachings of the invention to operate in the L-band, i.e., 1–2 GHz. As shown in the output power waveform 120 of FIG. 7, the BWO produced peak-power over 1 MW with pulse lengths of approximately 100 microseconds. The beam current was approximately 160 amps and the beam voltage was approximately 75 kV, as shown respectively in the waveforms 122 and 124 of FIGS. 8 and 9. This performance was realized with a BWO diameter less than 10 centimeters, a BWO length less than 1.8 meters and a BWO weight less than 45 kilograms. In addition, exemplary helix coupling structures in accordance with FIGS. 2–5 were subjected to peak output powers exceeding 4 MW without electrical breakdown.

From the foregoing it should now be recognized that embodiments of microwave amplifiers and oscillators have been disclosed herein that are configured with a hollow helix slow-wave structure and a helix-waveguide coupling structure especially suited to facilitate liquid cooling of the helix. Microwave tubes in accordance with the present invention permit operation in the lower microwave region without the necessity of a consequent increase in tube diameter. The helix facilitates tight electromagnetic coupling with an electron beam injected therethrough from a plasma-cathode electron gun.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A plasma-assisted, microwave source configured to amplify a microwave signal with the aid of an ionizable gas and without the aid of magnetic beam-focusing structures and to be cooled by a cooling liquid, said source comprising:

a source waveguide configured with a wall and having first and second ends;

a plasma-cathode, electron gun coupled to said source waveguide first end;

a collector coupled to said source waveguide second end;

first and second apertures defined by said source waveguide wall;

input and output waveguides which are joined to said source waveguide wall and arranged to physically communicate respectively through said first and second apertures with said source waveguide, each of said input and output waveguides having a respective wall;

a helix configured with a hollow interior and first and second ends, said helix positioned within said source waveguide;

first and second waveguide antennas comprising extensions of said first and second helix ends away from said helix, said extensions passing respectively through said first and second apertures and joining said first and second helix ends in an orthogonal relationship respectively with the walls of said input and output waveguides;

first and second liquid coupling ports comprising further extensions of said first and second helix ends through the walls of said input and output waveguides respectively, said first and second liquid coupling ports coupled to said hollow interior for communication of said cooling liquid into and out of said hollow interior; and first and second pressure windows positioned respectively across said input and output waveguides, with said first and second waveguide antennas between said source waveguide and said first and second pressure windows respectively;

wherein;

said source waveguide and said first and second pressure windows are configured to receive and contain said ionizable gas about said helix and said first and second waveguide antennas;

said electron gun is configured to inject an electron beam through said helix and through said ionizable gas to said collector, said electron beam thereby generating a plasma channel in said ionizable gas which assists in the confinement and transport of said electron beam to said collector;

said input waveguide and said first waveguide antenna receiving and coupling said microwave signal onto said helix so that said microwave signal interacts with and is amplified by said electron beam; and said second waveguide antenna and said output waveguide coupling said amplified microwave signal from said helix.

2. The plasma-assisted, microwave source of claim 1, wherein said source waveguide is a circular waveguide and said input and output waveguides are each rectangular waveguides.

3. The plasma-assisted, microwave source of claim 2, wherein said helix and said source waveguide each have a respective diameter and said source waveguide diameter is between 1.5 and 3 times said helix diameter.

4. The plasma-assisted, microwave source of claim 1, wherein said plasma-cathode, electron gun includes:

a plasma cathode configured as an electron source;

a grid; and an anode;

wherein:

said grid is spaced from said anode to receive a beam voltage across said grid and said anode;

said grid and said anode are positioned with said grid adjacent said cathode to extract said electron beam from said electron source; and said grid and said anode are further positioned to inject said electron beam through said helix and said ionizable gas.

5. A plasma-assisted, microwave source configured to generate a microwave signal with the aid of an ionizable gas and without the aid of magnetic beam-focusing structures and to be cooled by a cooling liquid, said source comprising:

a source waveguide configured with a wall and having first and second ends;

a plasma-cathode, electron gun coupled to said source waveguide first end;

a collector coupled to said source waveguide second end;

first and second apertures defined by said source waveguide wall;

input and output waveguides which are joined to said source waveguide wall and arranged to physically communicate respectively through said first and second apertures with said source waveguide, each of said input and output waveguides having a respective wall;

a microwave load coupled to said input waveguide;

a helix configured with a hollow interior and first and second ends, said helix positioned within said source waveguide;

first and second waveguide antennas comprising extensions of said first and second helix ends away from said helix, said extensions passing respectively through said first and second apertures and joining said first and second helix ends in an orthogonal relationship respectively with the walls of said input and output waveguides;

first and second liquid coupling ports comprising further extensions of said first and second helix ends through the walls of said input and output waveguides respectively, said first and second liquid coupling ports coupled to said hollow interior for communication of said cooling liquid into and out of said hollow interior; and first and second pressure windows positioned respectively across said input and output waveguides, with said first and second helix ends between said source waveguide and said first and second pressure windows respectively;

wherein:

said source waveguide and said first and second pressure windows are configured to receive and contain said ionizable gas about said helix and said first and second waveguide antennas;

said electron gun is configured to inject an electron beam through said helix and through said ionizable gas to said collector, said electron beam thereby generating a plasma channel in said ionizable gas which assists in the confinement and transport of said electron beam to said collector said microwave load, said input waveguide and said first waveguide antenna permitting said microwave signal to be generated along said helix through interaction with said electron beam; and said second waveguide antenna and said output waveguide coupling said microwave signal from said helix.

6. The plasma-assisted, microwave source of claim 5, wherein said source waveguide is a circular waveguide and said input and output waveguides are each rectangular waveguides.

7. The plasma-assisted, microwave source of claim 6, wherein said helix and said source waveguide each have a respective diameter and said source waveguide diameter is between 1.5 and 3 times said helix diameter.

8. The plasma-assisted, microwave source of claim 5, wherein said plasma-cathode, electron gun includes:

a plasma cathode configured as an electron source;

a grid; and an anode;

wherein:

said grid is spaced from said anode to receive a beam voltage across said grid and said anode;

said grid and said anode are positioned with said grid adjacent said cathode to extract said electron beam from said electron source; and said grid and said anode are further positioned to inject said electron beam through said helix and said ionizable gas.

* * * * *